United States Patent [19]

Jenkins et al.

[11] Patent Number: 4,684,194

[45] Date of Patent: Aug. 11, 1987

[54] ZERO INSERTION FORCE CONNECTOR

[75] Inventors: John W. Jenkins, Mt. Prospect; William F. Laubach, Elk Grove Village, both of Ill.

[73] Assignee: TRW Inc., Redondo Beach, Calif.

[21] Appl. No.: 833,662

[22] Filed: Feb. 25, 1986

Related U.S. Application Data

[63] Continuation of Ser. No. 631,033, Jul. 16, 1984, abandoned.

[51] Int. Cl.[4] ..... H01R 9/09

[52] U.S. Cl. ..... 439/260; 439/636

[58] Field of Search ..... 339/74 R, 75 MP, 176 MP, 339/220 R, 221 R, 221 M

[56] References Cited

U.S. PATENT DOCUMENTS

| | | | |
|---|---|---|---|
| 2,231,347 | 2/1941 | Reutter | 339/221 R |
| 3,475,717 | 10/1969 | Lane | 339/176 MP |
| 3,526,869 | 9/1970 | Conrad et al. | 339/75 MP |
| 4,080,027 | 3/1978 | Benasutti | 339/75 MP |
| 4,169,644 | 10/1979 | Bonhomme | 339/75 MP |
| 4,188,085 | 2/1980 | Aldridge et al. | 339/176 MP |
| 4,357,066 | 11/1982 | Cairns et al. | 339/176 MP |
| 4,428,633 | 1/1984 | Hamsher, Jr. et al. | 339/75 MP |
| 4,480,884 | 11/1984 | Babuka et al. | 339/75 MP |
| 4,542,950 | 9/1985 | Gillett et al. | 339/75 MP |
| 4,544,223 | 10/1985 | Gillett | 339/75 MP |
| 4,548,452 | 10/1985 | Gillett | 339/75 MP |

*Primary Examiner*—John McQuade

*Attorney, Agent, or Firm*—Joseph P. Calabrese; Sol L. Goldstein

[57] ABSTRACT

A high density, zero-insertion-force electrical circuit board connector is provided comprising an insulator body having walls defined in part by reciprocally movable cams. Contacts with offset terminal portions are arranged in close-packed array and are simultaneously cammed into the closed position by cam followers mounted in a reinforced insulator housing.

1 Claim, 19 Drawing Figures

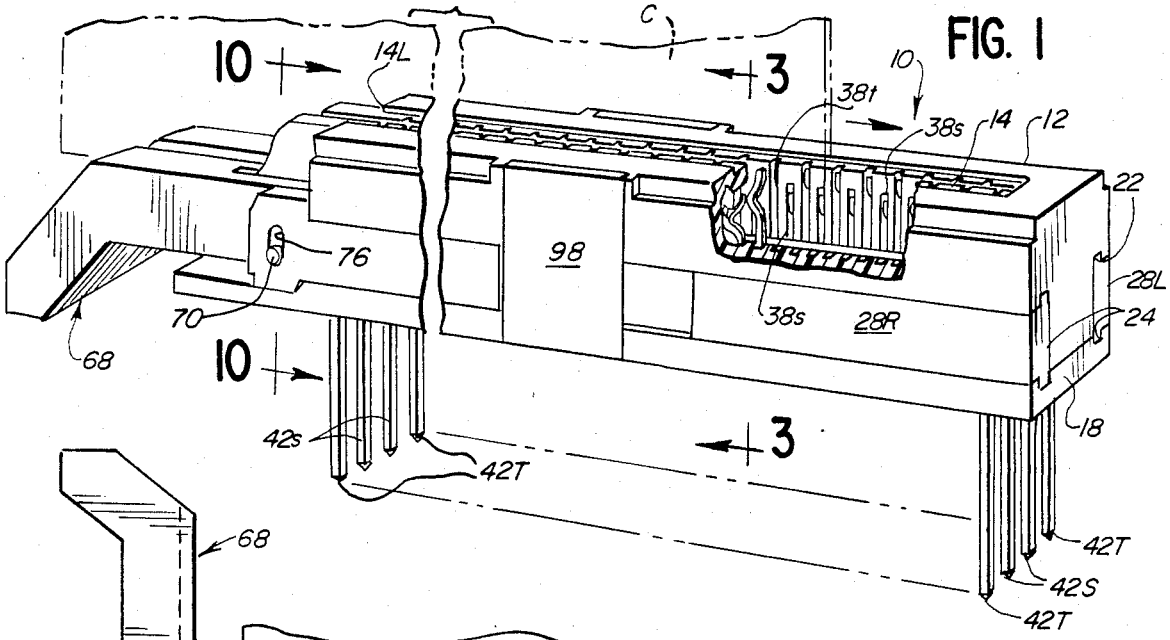
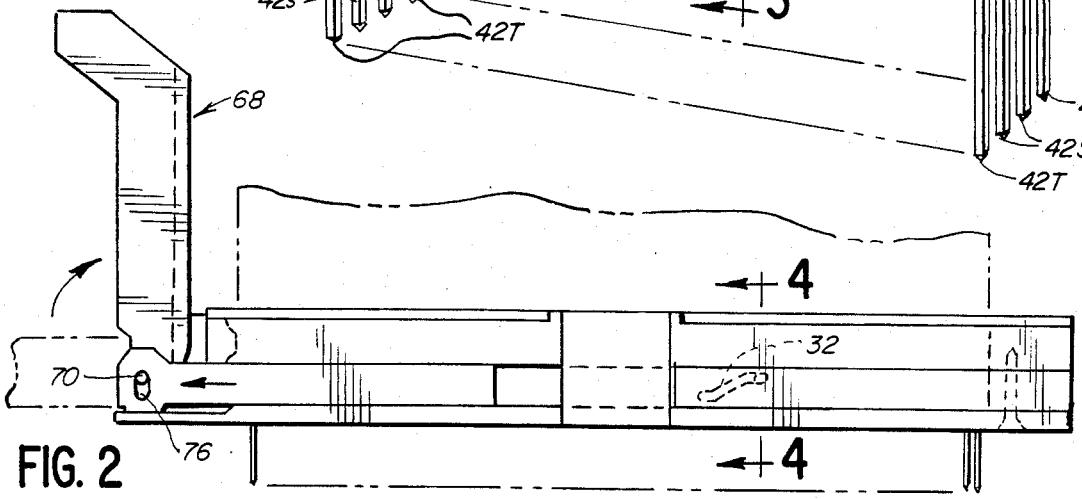
FIG. 2
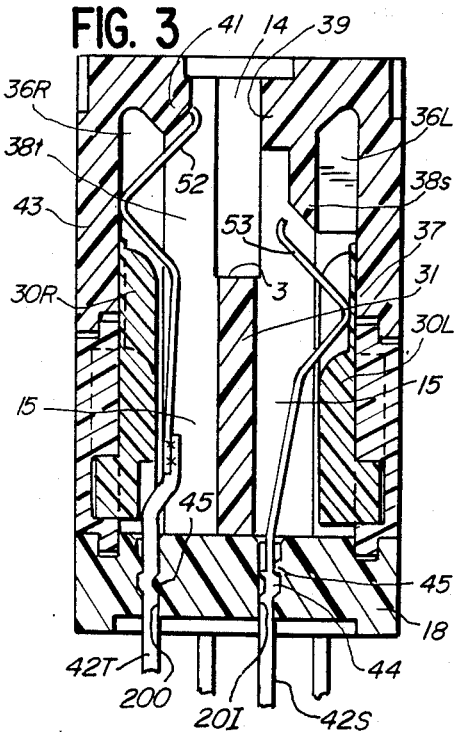
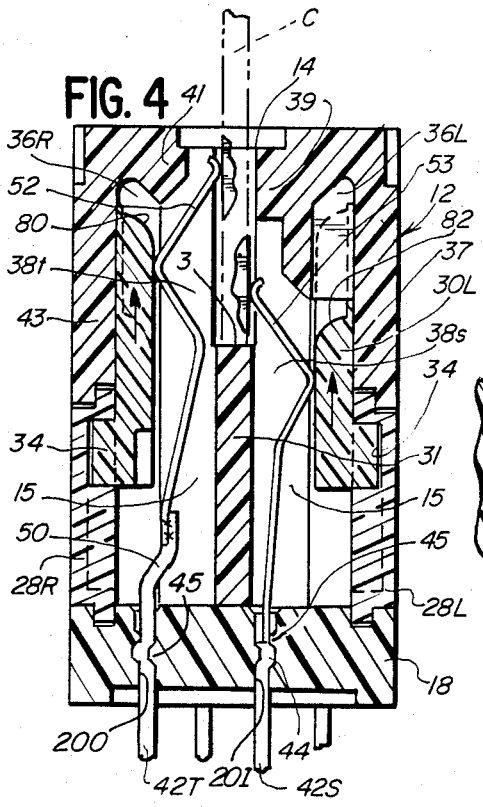
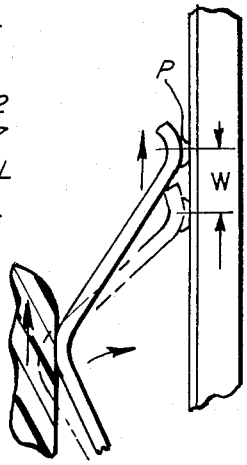
FIG. 5

FIG. 7
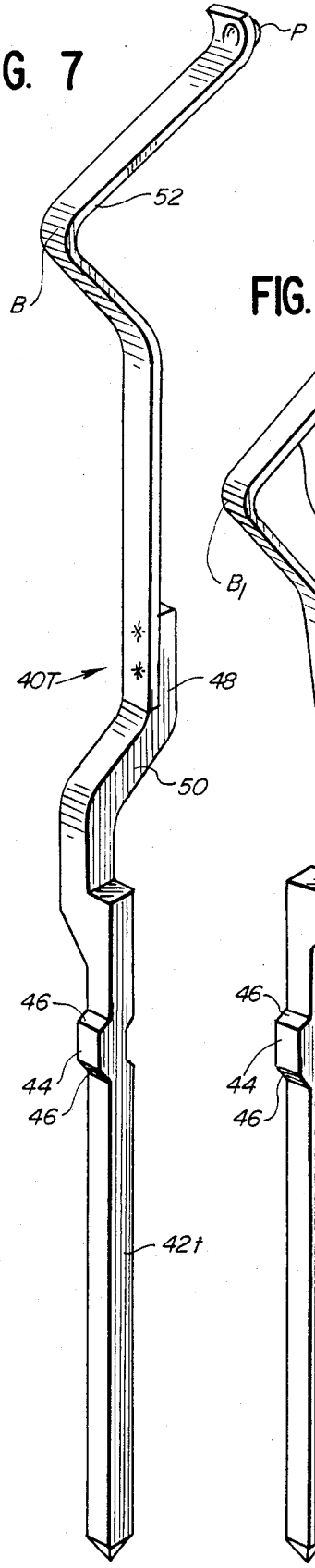
FIG. 8
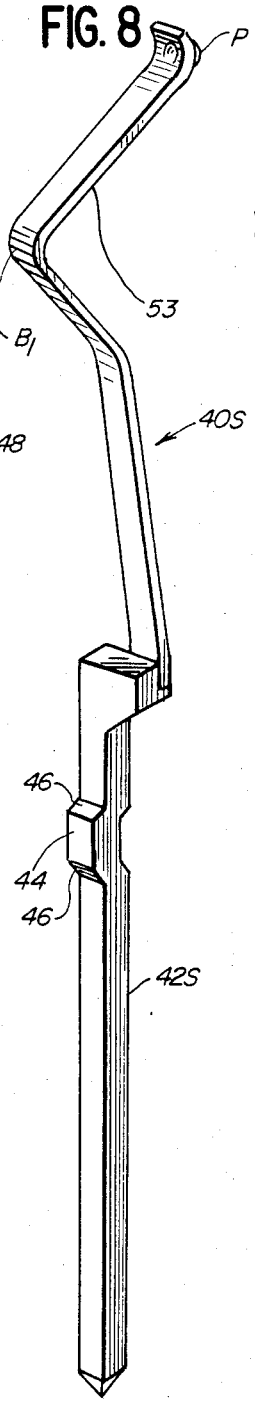
FIG. 9A
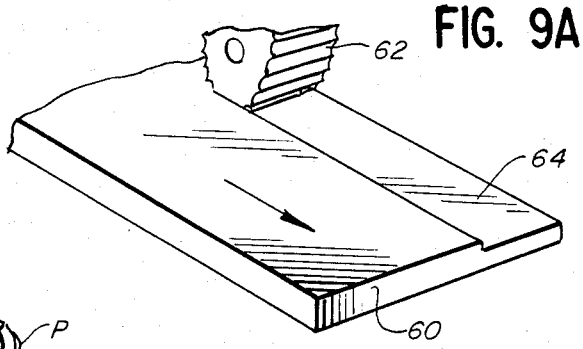
FIG. 9B
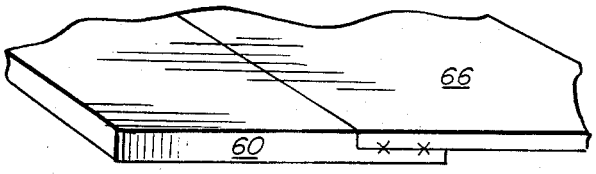
FIG. 9C
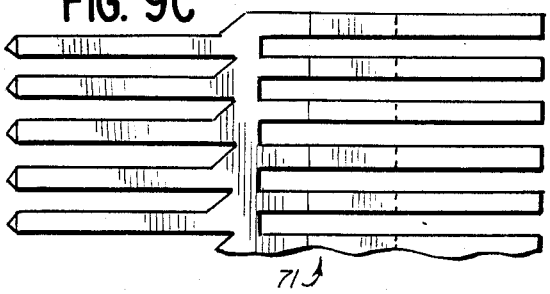
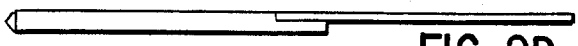
FIG. 9D
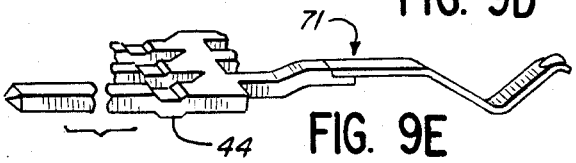
FIG. 9E
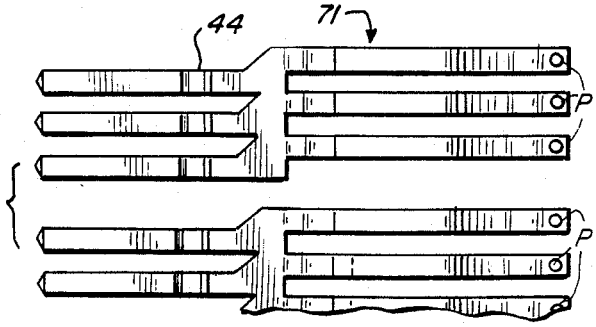
FIG. 9F FIG. 10
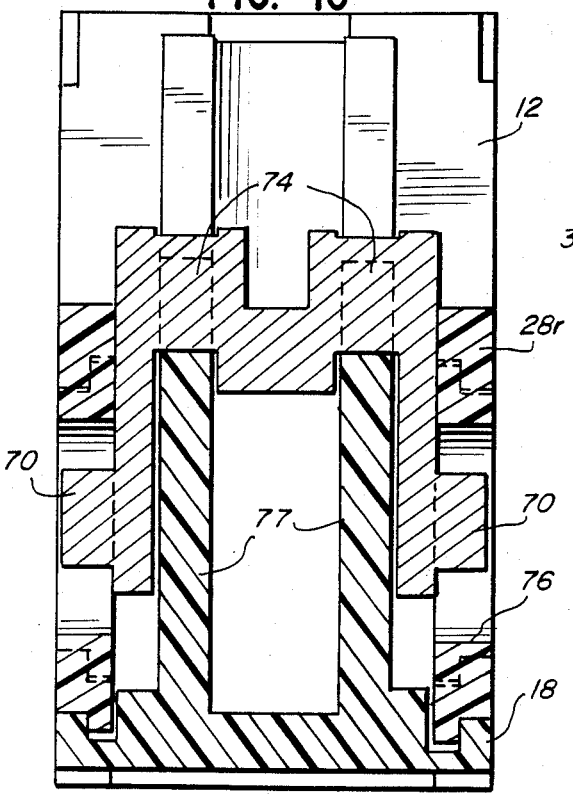
FIG. 11
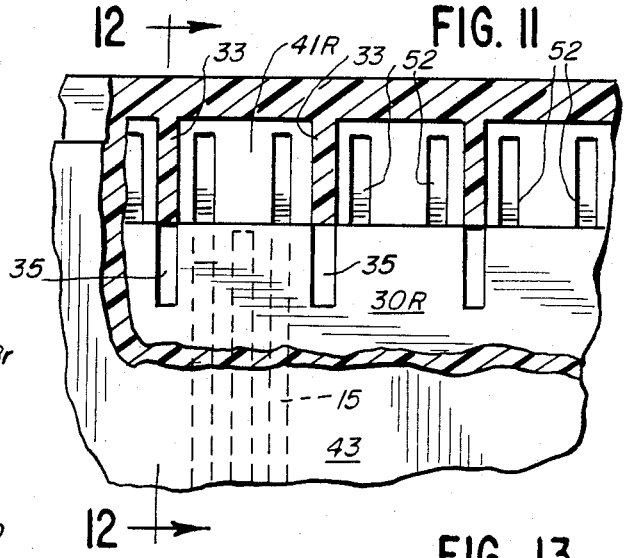
FIG. 13
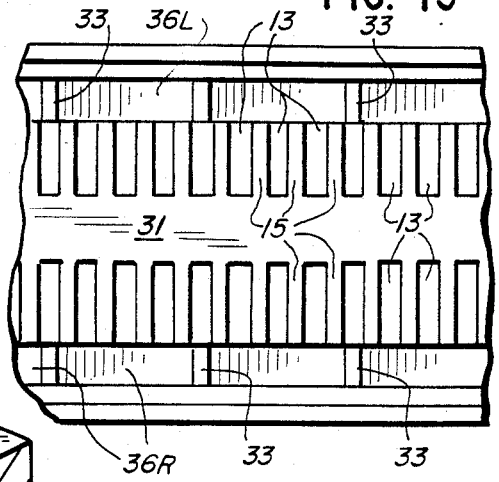
FIG. 12
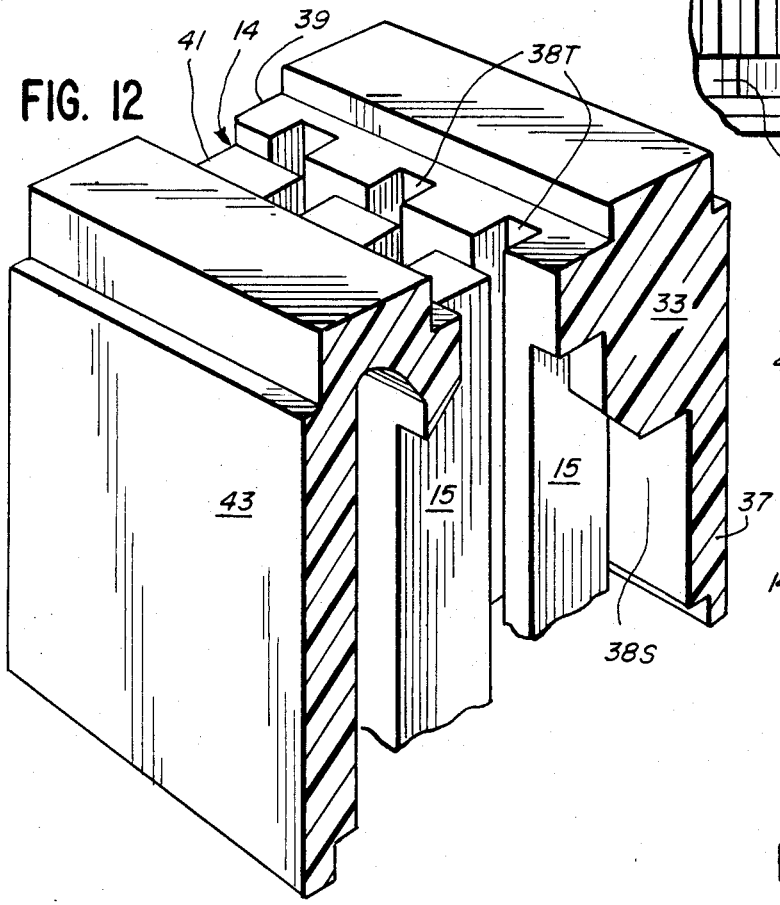
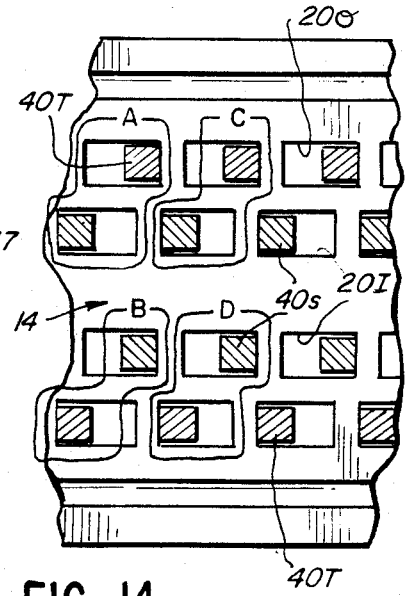
FIG. 14

ZERO INSERTION FORCE CONNECTOR

This application is a continuation of application Ser. No. 631,033, filed July 16, 1984, now abandoned.

FIELD OF THE INVENTION

This invention relates to an electrical connector and more particularly pertains to a high-density, zero-insertion-force (ZIF) electrical circuit board connection having contacts providing a desired wiping action when engaging a board inserted therein.

DESCRIPTION OF THE PRIOR ART

Electrically conductive paths on printed circuit boards consist of thin coatings of conductive material which are printed, or otherwise deposited or formed on one or both sides of such boards. The normally miniature size of these conductive paths as well as their frail nature result in a variety of interconnection problems. Thus poor electrical engagement between the connector contacts and the circuit board will result from fractures in the board circuits and undesired bending and/or mis-alignment of terminal or board-engaging portions of the connector contacts. The incidence of such problems increases with contact density.

Zero-insertion-force connectors are designed to minimize deleterious stresses in the course of circuit board insertion into a connector by employing contact terminal strips which are positioned out of the circuit board path in the course of board insertion into a receiving connector slot. The contact strips are then cammed or released from an open position into engagement with the board which is located in the connector slot in desired registration with the engaging contact strips.

A desired action of each contact relative to the engaged circuit board is a sliding frictional movement or "wipe" of the contact portion engaging the board surface over the circuit portion engaged. Such wiping action is particularly beneficial, if not necessary, to efficient electrical contact when the circuit boards are exposed to contaminating atmospheres prior to or during connector engagement. The wiping action will serve to remove any surface contamination on the board circuit tending to reduce electrical engagement with the contact.

The prior art has recognized the desirability of minimizing the application of edge stresses on circuit boards and accordingly has employed zero-insertion-force connectors, as evidenced by the one-piece ZIF connector disclosed in Hamsher et al. U.S. Pat. No. 4,428,635. The connector of this patent employs contacts which are normally in the closed position. Such contacts are cammed into an open position to allow insertion of a mating circuit board into a receiving slot. Following board insertion, the contacts are released into engagement with the board whereby any normal force or wiping action exerted by the contacts on the engaged board is effected by the resiliency possessed in the contact members. In contrast, the connector hereinafter described employs normally open contacts and associated cam means for positively applying forces which result in movement of the contact terminal portions engaging inserted board circuitry. The forces are applied both normal and transversely to the plane of the board as will hereinafter be explained in greater detail.

The article "Twin-Contact Connector" by J. A. Colletti et al. appearing in the IBM Technical Disclosure Bulletin, Vol. 14, No. 9 of February 1972 discloses an early recognition in the prior art of the desirability of a normally-open connector for circuit boards to minimize the application of concentrated deleterious stresses along the edges of such boards. This article discloses the use of cam means for effecting movement of cantilevered contacts having vertically spaced contact points which are cammed inwardly into electrical engagement with an interposed circuit board. The lower contact point on each board side is described as effecting a board "holding" function whereas the upper contact point on each board side is stated to "engage and wipe" a metallized board contact. The contacts disclosed in the article are of such design and structure as to provide a minimum wiping action. The contacts of the connector hereinafter described in detail provide a desired contact travel over the surface of the engaged board while simultaneously providing a desired force component normal to the board surface.

Various prior art disclosures of ZIF connectors incorporating contact-actuating cam means, contact structures and insulator housings comprise the following U.S. Pat. Nos.: Douty et al. 4,380,402; Bright et al. 4,3443,524; Bobb et al. 4,332,431; Goldmann et al. 3,727,173; McIver 3,793,609; Crane 3,818,419; Harwood et al. 3,858,957; Schell 4,220,389; Bethurum 4,269,462; Chalmers 4,257,660; Sochor 4,275,944; Griffith et al, 4,288,140. The desirability of employing a contact wiping action for contaminant removal is also disclosed in certain of the foregoing prior art dealing with ZIF connectors as well as Cobaugh et al. U.S. Pat. No. 4,288,139. Copending Lumpp U.S. application Ser. No. 510,605 owned by the assignee of this application also discloses a ZIF connector construction which employs rotary cam-actuated contact actuator and board locator. The disclosure of this copending application is incorporated herein by reference.

OBJECTS OF THE INVENTION

It is an object of this invention to provide a novel ZIF connector employing contacts providing desired forces normal to an engaged board surface as well as desired wiping action in the course of effecting electrical contact with said board.

It is another object of this invention to provide contacts particularly designed for use in high-density connectors and a method of making the same.

It is a further object of the invention to provide a compact, high-density connector construction composed of a minimum number of elements of simple design which cooperate to provide efficient electrical communication with an engaged connector such as a PC board.

It is yet another object of the invention to provide a ZIF connector having high contact density and insulator housing design of exceptional strength whereby significant contact-bending forces may be simultaneously applied without damage to the housing.

The foregoing and other objects of this invention will become more apparent from the following detailed description when read in the light of the accompanying drawing and appended claims.

SUMMARY OF THE INVENTION

In accordance with one embodiment of this invention, a zero-insertion-force connector is provided comprising a insulator housing in which a plurality of normally open electrical contacts are mounted. Each contact comprises a rigid, straight, anchor pin portion mounted in an apertured housing base. Each contact pin portion is connected to a thinner contact terminal portion adapted to be cammed into a high-normal-force wiping engagement with a circuit board. The contacts are preferably arranged in opposed rows on opposite sides of a longitudinal insulator opening adapted to receive a circuit board.

Following insertion of a circuit board into such opening and registration of the board relative to the opposed open contacts, the contact flexible terminal portions containing reverse bends are cammed into the closed position. The cam means comprise slidable cam-cam-follower assemblies mounted in the connector insulator housing and defining a portion thereof. Reciprocal axial movement of cam strips slidably mounted in opposed insulator sides results in actuation of spaced surfaces of engaged cam followers to move in the vertical plane so as to inwardly move an adjacent bend portion of each contact terminal portion and urge each contact terminal portion inwardly and slidably upward over an engaged board surface.

By laterally offsetting the board-engaging terminal portion of each contact relative to its anchoring pin portion and alternating the lateral direction of offset in aligned contacts, a high density, close-packed contact arrangement is possible. Despite such contact density and the resultant forces on the insulator walls tending to separate such walls, a reinforced insulator design dissipates such forces. The provided reinforcements enables the simultaneous application of large board-engaging forces on the PC board engaged without resulting damage to the insulator housing as will hereinafter be explained in greater detail.

DESCRIPTION OF THE DRAWINGS

For more complete understanding of this invention reference should now be made to the embodiment illustrated in the accompanying drawings and described below by way of an example of the provided invention. In the drawings:

FIG. 1 is a perspective view partly broken away of a zero-insertion-force connector made in accordance with the teachings of this invention and illustrating in phantom a mating connector such as a printed circuit board in the course of insertion into such connector;

FIG. 2 is a side elevational view of the assembly of FIG. 1 after the circuit board has been fully inserted in the connector;

FIG. 3 is a transverse sectional view taken on line 3—3 of FIG. 1;

FIG. 4 is a transverse sectional view taken on line 4—4 of FIG. 2;

FIG. 5 is a fragmentary side elevational view, partly in section, illustrating the vertical movement or "wipe" of a terminal portion of a contact employed in the connector of this invention in the course of being cammed into engagement with a printed circuit board;

FIGS. 7 and 8 are perspective views illustrating two contacts of different size which may be employed in spaced rows in a zero-insertion-force connector made in accordance with the teachings of this invention;

FIG. 9A is a fragmentary perspective view illustrating a skiving step employed in preparing a metallic sheet to be subsequently employed in forming a plurality of contacts made in accordance with the teachings of this invention;

FIG. 9B comprises a fragmentary view of the processed sheet of FIG. 9A in engagement with a thinner sheet from which thinner terminal portions of contacts made in accordance with this invention are to be formed;

FIG. 9C illustrates a "comb" formed from the sheet assembly of FIG. 9B following a blanking operation;

FIG. 9D is representative of a plating step which is effected subsequent to the blanking operation on the comb illustrated in FIG. 9C;

FIG. 9E is a fragmentary view representative of a forming step effected on the comb of FIG. 9C following the plating operation;

FIG. 9F is representative of a final cutting step whereby individual contacts are formed from the formed plated comb of the prior views;

FIG. 10 is a transverse sectional view taken on line 10—10 of FIG. 1;

FIG. 11 is a fragmentary sectional view, partly in elevation, of a wall portion of the insulator housing of the provided connector;

FIG. 12 is a prespective view taken along line 12—12 FIG. 11, and

FIG. 13 is a fragmentary plan viewe looking into the bottom of the upper insulator housing.

FIG. 14 is a schematic representation of contact arrangements relative to a board-receiving opening.

DETAILED DESCRIPTION OF THE INVENTION

Figure 6:
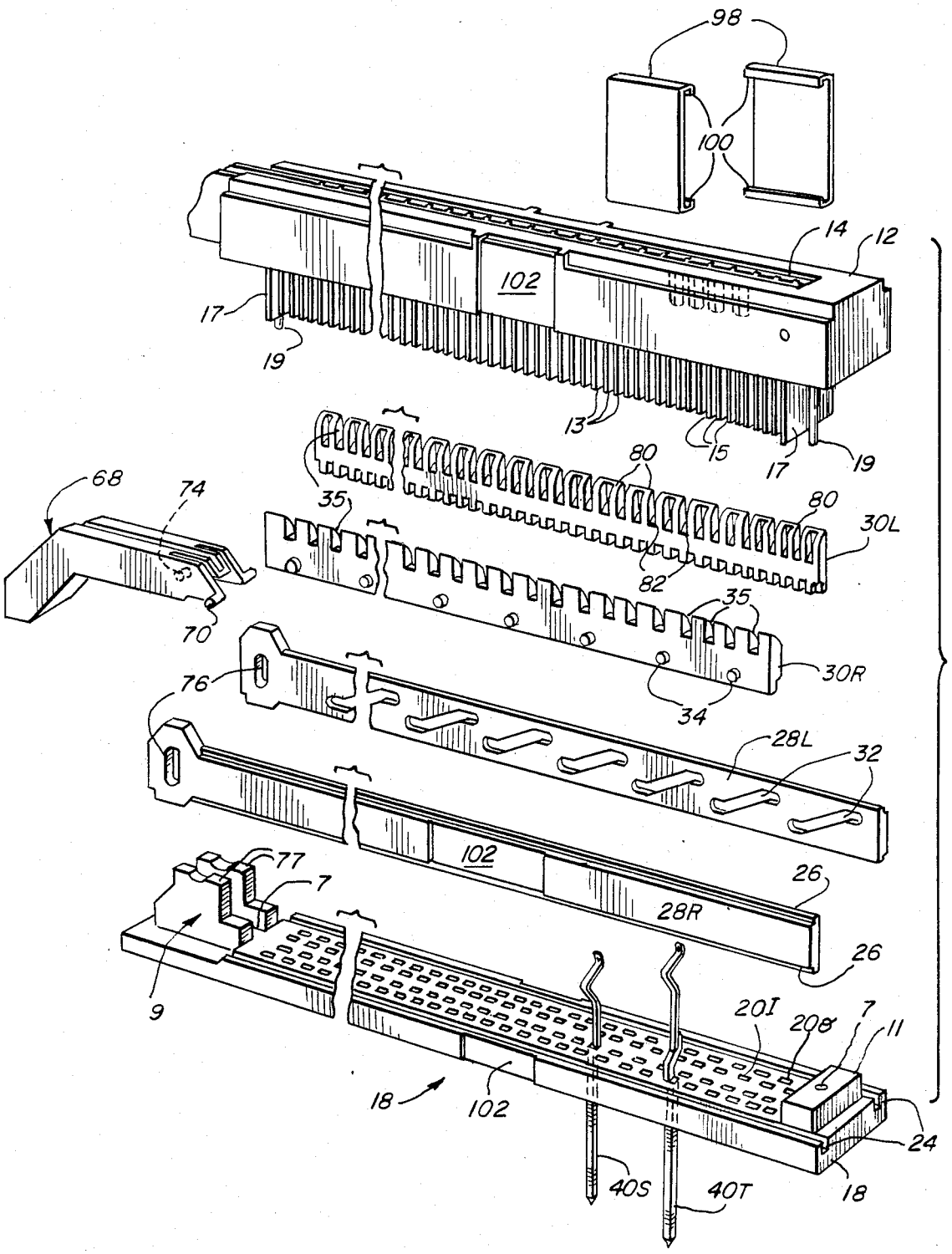
FIG. 6 is an exploded view illustrating basic components of a zero-insertion-force connector made in accordance with the teachings of this invention.

Referring now to the drawings and more particularly to FIG. 1, a zero-insertion-force electrical circuit board connector 10 is illustrated comprising an upper insulator body portion 12 having a longitudinal, elongate slot opening 14 to the top and at the left end of the upper housing 12 at 14L to receive a circuit board C illustrated in phantom. Upper insulator housing 12 is mounted over insulator base 18 which has a plurality of contact receiving openings arranged in opposed parallel rows of outer openings 20O and inner openings 20I as is more clearly seen from the exploded view of FIG. 6. Lower edge portions of the upper insulator 12 and upper edge portions of the lower insulator 18 are slotted at 22 and 24, respectively, see FIG. 1, for purposes of receiving in mating relationship opposed longitudinal edge portions 26 of reciprocally movable cams, see FIG. 6. The connector 10 employs a right-hand cam 28B and an opposed cam 28L as seen in FIGS. 1 and 6. Axially movable cams 28R and 28L are adapted to actuate for movement in the vertical plane, engaged cam followers 30R and 30L, respectively.

Each cam 28L and 28R has formed on an inner surface thereof sloping recesses 32 adapted to engage a projecting stub or tab 34 formed on an adjacent surface of the cam follower with which engaged. Thus slidable axial movement of each cam strip 28R and 28L, confined in the slots of the insulator upper housing 12 and lower housing 18, will effect movement in the vertical plane of the cam followers 30R and 30L. The latter as is more clearly seen from FIGS. 3 and 4 are slidably received in slots 36L and 36R formed in the upper insulator member 12.

The cam strips are non-load bearing as opposed ends of the upper housing 12 are supported on opposed bearing blocks 9 and support block 11 of base 18. Pins 19 depending from upper housing 12 are received in underlying openings 7 for registration purposes (see FIG. 6). Slot 36L (see FIGS. 3, 4) is defined by the inner surface of outer insulator wall 37 and opposed distal edges of insulator parallel barrier walls 15 which define contact-receiving recesses 13 in which the connector contacts are received, see FIGS. 6 and 13. The lower inner edge portions of barrier walls 15 are integrally formed with wall 31, the upper end of which defines slot bottom B, see FIGS. 3 and 4.

The ends of the cam followers are guided in their vertical movement by the large end insulator walls 17 also seen in FIG. 6. The upper inner edges of the parallel barrier walls 15 in the left and right connector portions of FIGS. 3 and 4 are integrally formed with slotted faces 39 and 41, respectively. Slot 36L is defined by insulator outer wall 43 and the spaced distal edges of barrier walls 15. The opposed adjacent faces of slotted walls 39, 41 define board-receiving slot 14, see FIGS. 3, 4 and 12.

As is seen in FIGS. 1, 3 and 4, transversely disposed to each slot 36L and 36R thereto along the length of walls 39 and 41 are intersecting, alternating slots 38S and 38T. These slots are seen in front elevation in the broken away segment in FIG. 1 of the drawing, and are seen in section in the transverse sectional views comprising FIGS. 3 and 4 of the drawing. The longer slots 38T are traversed by terminal portions 52 of contacts 40T (see FIG. 7) whereas the shorter slots 38S are traversed by terminal portions 53 of shorter contacts 40S (see FIG. 8).

Contacts 40T and 40S comprise lower pin or anchor portions 42T and 42S respectively, which have formed therein locking offset 44 with opposed sloping edge portions 46 (see FIGS. 3, 4). The contact portions 42T and 42S comprise anchoring pins or post portions which are insertable in the openings 20O and 20I respectively, of the insulator base 18 illustrated in FIG. 6. FIG. 6 illustrates a single contact 40T inserted in a base opening 20O and a single contact 40S inserted in a base opening 20I. In the normal assembled condition, each opening 20O will have received therein a contact 40T, and each opening 20I will have received therein a contact 40S.

It will be noted from FIG. 7 that each contact 40T has integrally formed with its lower pin portion 42T an upper offset continuation 48 which is laterally offset from the axis of pin portion 42T and disposed in a spaced parallel plane by means of the inclined connecting portion 50. Secured to an inner surface portion of contact extension portion 48 is a flexible contact terminal portion 52 which is half the thickness of the underlying contact portion to which secured by electron welding or the like. By way of example, the contact terminal portion 52 having a reverse bend B formed therein may be approximately 0.010 inch thick whereas the underlying contact pin portion 42T, 50 and 48 may have double such thickness. Contact portions 42T and 42S are of substantially square cross-section and of greater rigidity than the opposed contact terminal portions 52 and 53, respectively.

The difference in the heights of the two contacts 40T and 40S of FIGS. 7 and 8 respectively, comprises the added length afforded the contact 40T by the contact portions 48 and 50. It will be noted from FIG. 8 that the contact terminal portion 53 of contact 40S is of substantially the same size and configuration as contact portion 52 of contact 40T. The lower end of the contact terminal portion 53 is secured to the upper end of the pin portion 42S of the contact 40S by electron welding or the like.

It will be further noted that in the contact 40S, the contact terminal portion 53 may be offset to the right of the longitudinal axis of the contact pin portion 42S whereas in the contact 40T of FIG. 7, the contact terminal portion 52 may be offset to the left of the longitudinal axis of the pin portion 42T as above mentioned. By virtue of the lateral offset disposition of the flexible contact portions 52 and 53 of the contacts 40T and 40S of FIGS. 7 and 8 respectively, the contact terminal portions 52 and 53 may be laterally spaced on opposite sides of a straight axis on which the pins 42T, 42S are disposed.

Reference will now be made to FIG. 14 wherein it will be noted that a schematic representation is provided of contacts 40T located in the outer rows of openings 20O having terminal portions 52 offset to the left as indicated by the dark shading, and the contacts 40S disposed in the inner rows of openings 20I having contact terminal portion 53 offset to he right as indicated by the dark shading. Thus, in a series of four axially pinaligned contact extending transversely to the longitudinal axis of the card opening, transversely aligned Series A and B and transversely aligned Series C and D, the longer contact 40T of Series A and C will be in alignment with the oppositely disposed shorter contact of the Series B and D, and the shorter contact 40S of each Series A and C will be in oppositely disposed in alignment with the taller contact 40T of the Series B and D, respectively. Such arrangement enables simultaneously actuating cams to simultaneously cam all of the closely-spaced contacts into engagement with a PC board resulting in uniform loading of the board on the opposite sides without shorting occasioned by undesired contact engagement. This is made possible in part by the offset portions of contacts 40T which enable contacts on the same side of the opening 14 to have their terminal portions 52 or 53 in the same parallel plane.

FIGS. 9A to 9F illustrate the process steps which may be carried out in the course of forming the contacts 40T and 40S of FIGS. 7 and 8, respectively. In FIG. 9A a sheet 60 from which the lower rigid contact portions 42T and 42S are to be formed has an edge portion skived, to a reduced thickness as by a cutting wheel 62 or the like to form edge 64 of reduced thickness; plate 60 may originally have a uniform thickness of approximately 0.024 inch. Following the skiving step, a thinner sheet 66 from which the contact terminal portions 52 and 53 are to be formed, is secured as by electron welding or the like to the edge portion 64 of reduced thickness.

Following the welding of the two sheets together, the assembled sheets are blanked into the comb-like arrangement 71 of FIG. 9C. The comb 71 formed of sheets 60 and 66 of berylium copper may then be surface plated as represented by FIG. 9D with a desired electrically conductive material such as gold or the like. The comb is then formed so as to form the reverse bends in the thinner contact terminal portions as well as the offset locking tabs 44 employed for locking or anchoring each resulting contact in its respective insulator opening. A contact projection P may also be formed in each contact 40T, 40S on the ends of the terminal portions 52, 53.

Following the forming step of FIG. 9E, the individual contacts are cut from the comb and inserted in the insulator base 18 of the exploded view of FIG. 6.

The lower contact pins or post portions 42T and 42S which may be received in a mother board or serve as wire wraps, are received in a press fit in the base insulator openings. By virtue of the contact offset portions 44 being forced past cross-ribs 45 in the pin-receiving insulator passageways, see FIGS. 3 and 4, and fracturing the same as the ribs are traversed, the contacts are locked in a secure press fit with material remaining on the cross-ribs. Such engagement eliminates the danger of damaging, as by cracking or the like, of the insulator body defining the pin openings if the body only was directly engaged in press-fit engagement.

After the contacts 40T and 40S have been mounted in the insulator openings 20I and 20O, respectively, the base 18 is assembled with the opposed cams 28R and 28L which engage cam followers 30R and 30L and together with handle 68 having pivot pin 70 and cam actuating pin 72 are assembled with the upper insulator 12 into the configuration of FIGS. 1 and 2.

In the course of such assembly, the contact terminal portions 52 and 53 are received in the pockets 13 defined by the parallel barrier walls 15 of the upper insulator 12, see FIGS. 1 and 13. The lower portions of walls 15 extend laterally of central wall 31, see FIGS. 3, 4, and 13 which extends beneath the length of the slot 14 and above which slot bottom 3, see FIGS. 3 and 4, is disposed. The walls 15 also extend at right angles to the opposed slotted walls 39, 41, as previously noted and are integrally formed therewith. Thus a contact upon insertion into upper insulator 12 is confined between walls 15 at the sides, a slotted wall 39 or 41 at the front from which point terminal portion 52 or 53 projects (as seen in FIG. 1) and by outer walls 37 or 43 of the upper housing 12 and cam followers 30R, 30L at the rear. Upon cam actuation, the contacts are urged inwardly as seen in FIG. 4 by the cam followers 30L or 30R which at that instant function as a contact confining element. FIG. 11 of the drawing illustrates wall 43 of FIG. 12 broken away to illustrate the approximate instant wherein the rising cam follower 30R cams inwardly the rearwardly extending portions of terminals 52.

FIG. 11 also illustrates slots 35 in follower 30R (and which are also in follower 30L), for purposes of receiving reinforcing ribs 33 which are integrally formed with the undersurface of the top of upper housing 12 and the outer walls 37 and 43. FIG. 12 illustrates a reinforcing rib 33 in section. The spaced ribs 33 overlie the shorter slots 38S. The ribs serve to dissipate the forces exerted by the cam followers tending to wedge the outer walls apart as the contact terminal portions 52, 53 are cammed inwardly. The ribs 33 also serve the function of cam follower alignment when being received in the follower slots 35.

It will be apparent from FIG. 3 of the drawing that by virtue of the offset 50 in the contact 40T, the terminal portion 52 thereof is approximately the same distance from the center line of the opening 14 for receiving the circuit board "C" as is the terminal portion 53 of the opposed shorter contact 40S.

With the contacts 40T and 40S in the position illustrated in FIG. 3 of the drawing, the actuating handle 68 is in the horizontal position of FIG. 1. Upon pivoting the handle upwardly ninety degrees into the position of FIG. 2, the cam strips slidably mounted between the upper housing 12 and the base 18, are pulled to the left by virtue of the engagement of actuating handle pins 70 with oval openings 76 of the enlarged cam ends. The handle 68 possesses spaced pivot pins 74 as illustrated in the sectional view of FIG. 10 mounted in the spaced bearing walls 77. Walls 77 are molded integrally with the connector base 18 as clearly seen in FIGS. 6 and 10. Accordingly, upon pivoting the handle upwardly, the cam is driven to the left in FIGS. 1 and 2, resulting in elevation of the cam followers 30R and 30L.

As a consequence of such cam follower elevation all of the contacts 40T and 40S have their terminal portions 52 and 53 urged inwardly in the manner illustrated in FIG. 4 of the drawing as upper cam edges 80 of the cam followers contact reverse bend portions B of each contact 40T, and as the lower cam edges 82 of each cam follower engage reverse bend portions B1 of the contacts 40S. See FIG. 4.

FIG. 5 illustrates the slidable movement or "wipe" W which the terminal portions of the contacts effect on the surface of a circuit board in the course of being urged inwardly by the actuating cam followers. It is apparent from FIG. 5 that each contact terminal portion has a significant force component effected normal to the board's surface as well as a wiping action effected parallel to the board's surface as the contact terminal portions move upwardly. The desired force components effect a desired wiping action removing any contamination on the board's surface and an efficient electrical contact is assured between the board's circuitry and the contact as a result of the high normal contact force exerted.

By way of example, contact terminal portions 52 or 53 may effect a load of approximately 150 grams on the engaged board, employing the connector construction above described. A total force in excess of 80 pounds may be applied by a system having opposed rows of contacts as above described. It is apparent that a significant force tending to wedge the outer walls of the upper housing apart results during the contact camming action wherein all a contacts are cammed inwardly simultaneously.

It is also possible of course to employ the above-described construction with contacts aligned along one side only of opening 14, and to employ a single contact row on one or both sides. The novel connector construction provided employs and efficient assembly of an integrally formed upper housing which receives cam followers and reciprocally movable cams in the wall portions thereof. Such housing is nevertheless able to resist the forenoted forces without fracture of the housing walls by employing the novel reinforcing ribs 33. The ribs dissipate any generated forces within the housing with the absence of any resulting damage.

As the above described contact PC board engagement effects a lifting action tending to raise the engaged circuit board C of the drawing from the connector 10, retaining means must be employed for insuring a desired car-connector assembly. Any of a variety of retention means may be employed for retaining a connector such as printed circuit board to the connector. Such retention means may comprise a tongue and groove interconnection between the inserted board and the connector, a friction cam means whereby the card is frictionally retained to the connector, or locking pins which may traverse the board and secure the same to the connector housing. Such retention means are well known in the art and need not be described in detail in connection with the provided connector.

In addition to the reaction forces tending to separate housing walls as above described in the course of contact actuation, the wiping action described has a tendency to separate the upper insulator 12 from the lower insulator 18. Accordingly, means such as interconnecting nut and bolt assemblies or the illustrated clip means 98 of FIG. 6 the drawing may be employed for maintaining the connector elements in a desired state of assembly. The clips 98 are substantially C shaped in cross section as more clearly seen from FIG. 6 of the drawing and have terminal lip portions 100 adapted to be received in cooperating recesses along the edges of opposite sides of the upper housing 12 and the base 18. The various exterior surfaces of the connector which normally would lie beneath the inner surface of the clips 98 may be appropriately relieved as indicated by the recesses 102 formed in the outer surfaces of the upper housing 12, the cams 28 and the insulator base 18 as viewed in FIG. 6. The recess in the cam must, of course, be of a greater length to allow the necessary reciprocal movement indicated in FIG. 2 of the drawing.

In accordance with the preferred embodiment of this invention the reinforcing ribs 33 are disposed between every two contacts 40T as illustrated in FIG. 11.

It is thus seen that the provided connector is composed of a relatively small number of parts comprising an integrally molded upper housing 12 illustrated in Fig. 6, to which the remaining elements of FIG. 6 are assembled and maintained in a state of assembly by the clips 98. The materials of the fabrication may be any suitable plastic having the desired physical properties such as moldability, strength characteristics, etc. A suitable material of fabrication for the upper housing 12 and base 18 is a polyphenylene sulfide sold under the trade name Ryton by Phillips Petroleum Company, the reciprocally movable cams and cam followers should preferably be fabricated of or coated with a material having a low coefficient of friction.

it is believed that the foregoing has made apparent a number of modifications which may be made in the disclosed connector construction which will not remove the resulting construction from the scope of the invention disclosed. Accordingly, this invention is to be limited only by the scope of the appended claims.

What is claimed is:

1. A zero insertion force electrical connector comprising an upper insulator housing portion having outer walls and an underlying insulator base portion; a plurality of cantilever contacts mounted on said base portion and having flexible portions with bend portions formed therein extending into said upper housing portion; said upper insulator portion having spaced inner slotted walls defining a central connector opening for reception of a connector board; barrier walls for receiving said contact flexible portions therebetween and extending from the inner walls in the direction of said outer walls; said barrier walls having spaced edges terminating short of an adjacent outer wall inner surface; and cam means reciprocally movable between said outer walls and the spaced barrier wall edges and movable into engagement with said contact bend portions for engaging said contact bend portions and camming the flexible contact portions into said central connector opening; spaced reinforcing ribs interconnecting upper, oppositely disposed inner surface portions of each of said outer walls and an adjacent slotted inner wall; said ribs being molded integrally with said outer and inner walls; said cam means having slotted upper edge portions for reception of said ribs therein at the end limit of said cam means movement into said upper insulator housing portion.

* * * * *